US007422095B2

(12) United States Patent
Yoshioka

(10) Patent No.: US 7,422,095 B2
(45) Date of Patent: Sep. 9, 2008

(54) BILL HANDLING DEVICE AND BILL ACCOMMODATING UNIT

(75) Inventor: Kazuei Yoshioka, Tokyo (JP)

(73) Assignees: Seta Corp., Tokyo (JP); Aruze Corp., Tokyo (JP)

( * ) Notice: Subject to any disclaimer, the term of this patent is extended or adjusted under 35 U.S.C. 154(b) by 0 days.

(21) Appl. No.: 11/280,814

(22) Filed: Nov. 17, 2005

(65) Prior Publication Data

US 2006/0118382 A1 Jun. 8, 2006

(30) Foreign Application Priority Data

Nov. 18, 2004 (JP) ..... 2004-335150

(51) Int. Cl.
*G07F 7/04* (2006.01)
*G07F 9/00* (2006.01)
*B65H 29/70* (2006.01)

(52) U.S. Cl. ..... 194/206; 194/342; 271/188

(58) Field of Classification Search ..... 194/205–207
See application file for complete search history.

(56) References Cited

U.S. PATENT DOCUMENTS 4,293,214 A * 10/1981 George et al. ..... 399/403
4,722,519 A * 2/1988 Zouzoulas ..... 271/181
4,977,583 A * 12/1990 Gorgone ..... 377/8
5,421,443 A 6/1995 Hatamachi et al.
5,494,144 A * 2/1996 Izawa ..... 194/203
5,564,545 A 10/1996 Suzuki
6,270,010 B1 8/2001 Junkins et al.
6,789,795 B2 * 9/2004 Kallin et al. ..... 271/272
7,175,015 B2 2/2007 Yoshioka
2001/0017276 A1 8/2001 Yasuda et al.
2002/0173874 A1 11/2002 Lax
2006/0102446 A1 5/2006 Yoshioka
2006/0180428 A1 8/2006 Yoshioka

FOREIGN PATENT DOCUMENTS

EP 0 762 344 3/1997
EP 1 471 021 10/2004
JP 08-123991 5/1996

* cited by examiner

*Primary Examiner*—Patrick Mackey
*Assistant Examiner*—Mark Beauchaine
(74) *Attorney, Agent, or Firm*—Leydig, Voit & Mayer, Ltd.

(57) ABSTRACT

It is an object to provide a bill handling device, the control of the entire device of which is simplified. The bill handling device comprises: a bill validator including a bill sensor for discriminating the validity of a bill inserted into a bill insertion slot and further including a bill conveyor for conveying the bill to a predetermined position and sending the bill, which has been discriminated to be invalid by the bill sensor, back to the bill insertion slot; and a bill accommodating unit including a bill accommodating section for accommodating a bill, further including a bill detector for detecting the bill which has been sent out, furthermore including a conveyance roller for conveying the bill to the bill accommodating section side independently from the bill conveyor by a conveyance force weaker than the conveyance force of conveying the bill by the bill conveyor while the bill detector is detecting the bill.

2 Claims, 11 Drawing Sheets

BILL HANDLING DEVICE AND BILL ACCOMMODATING UNIT

RELATED APPLICATIONS

This application claims the priority of Japanese Patent Application No. 2004-335150 filed on Nov. 18, 2004, which is incorporated by reference.

BACKGROUND OF THE INVENTION

1. Field of the Invention

The present invention relates to a bill handling device and a bill accommodating unit composing the bill handling device used for various game machines such as a slot machine, a pinball game machine and a card game machine and also used for a vending machine. These machines will be referred to as game machines hereinafter.

2. Description of the Related Art

Each game machine described above includes a bill handling device for discriminating the validity of a bill, which has been inserted into the machine by a user, and for accommodating the bill which has been discriminated to be genuine. This type bill handling device is incorporated into the game machine. Alternatively, this type bill handling device is incorporated into a device relating to the game machine, for example, this type bill handling device is incorporated into a so-called sandwich device arranged between the game machines. For example, as disclosed in Japanese Unexamined Patent Publication No. H8-123991, this type bill handling device includes: a bill validator for discriminating the validity of a bill which has been inserted into the machine by a user; and a bill accommodating device for successively accommodating the bill which has been discriminated to be genuine.

The bill validator of the above bill handling device includes: a bill detection sensor for detecting the passing of a bill; a discrimination sensor for discriminating the validity of the bill; a drive motor for conveying the bill; and a control section for controlling actuators including the drive motor and for judging the validity of the bill according to a detection signal sent from the discrimination sensor. The above bill accommodating device includes: a conveyance mechanism having a drive motor and conveyance rollers for conveying a bill, which has been judged to be genuine, to the accommodating section; and a pushing mechanism for putting the bill into the bill accommodating section so that the conveyed bills can be put on each other.

In general, the bill handling device disclosed in the above Patent Document 1 includes a control means for controlling the operation of the entire device as follows. Signals are sent and received between the bill validator and the bill accommodating device, and the validity of an inserted bill is discriminated. Further, the bill, which has been discriminated to be genuine, is conveyed, and the thus conveyed bill is accommodated in the bill accommodating section.

In this connection, in the above bill handling device, the bill validator for discriminating the validity of a bill, which has been inserted into the bill insertion slot, and the bill accommodating device are manufactured into separate bodies in many cases. Therefore, when the bill validator is incorporated into the bill accommodating device, the bill handling device can be composed. Therefore, for example, when the bill accommodating device and the bill validator are manufactured by different manufacturers, the following problems are encountered. When signals are sent and received between both the bill accommodating device and the bill validator, the protocol of the bill accommodating device and that of the bill validator must be made to agree with each other. In order to make the protocol agree with each other, it becomes necessary to rewrite the software or to provide an interface. Therefore, it takes time and labor. Further, control of the entire device such as control of sending and receiving signals between the bill validator and the bill accommodating device, control of conveying the bill and control of accommodating the bill becomes complicated.

SUMMARY OF THE INVENTION

The present invention has been accomplished to solve the above problems. It is an object of the present invention to provide a bill handling device in which the entire device can be easily controlled. Further, it is another object of the present invention to provide a bill accommodating unit into which various types of bill validators can be easily incorporated.

In order to accomplish the above objects, a first aspect of the present invention provides a bill handling device comprising: a bill validator including bill sensor for discriminating the validity of a bill inserted into a bill insertion slot, and bill conveyor for conveying the bill to a predetermined position and sending the bill, which has been discriminated to be invalid by the bill sensor, back to the bill insertion slot; and a bill accommodating unit including a bill accommodating section for accommodating a bill, bill detector for detecting the bill which has been sent out, and a conveyance roller for conveying the bill to the bill accommodating section side independently from the bill conveyor by a conveyance force not stronger than the conveyance force of conveying the bill by the bill conveyor while the bill detector is detecting the bill. According to the bill handling device of a second aspect of the invention, the bill detector is arranged at the predetermined position from which the bill conveyor sends out the bill.

According to the bill handling device composed as described above, it is judged by the bill sensor of the bill validator whether or not a bill inserted into the bill insertion slot is valid. In this case, the bill, which has been judged to be valid, is sent out by the bill conveyor to a predetermined position in the bill accommodating unit. At this predetermined position in the bill accommodating unit, the bill detector for detecting the bill is arranged. When the bill is detected, the conveyance roller is driven so that the bill can be conveyed toward the bill accommodating section. Therefore, the bill, which has been judged to be valid, is conveyed to the bill accommodating section by the rotation of the bill conveyor and the conveyance roller. On the other hand, in the case where the bill sensor has judged that the bill is invalid, the bill conveyor sends the bill back to the bill insertion slot, that is, the bill conveyor is reversely driven. At this time, a forward end portion of the bill is located at the predetermined position described above. Even when the bill detector detects the bill and the conveyance roller is rotated being driven, since a conveyance force of conveying the bill by the conveyance roller is set to be weaker than a conveyance force of conveying the bill by the bill conveyor, the bill is sent back to the bill insertion slot by the bill conveyor irrespective of the rotation of the conveyance roller.

In the case of conveying the bill which has been judged for the validity, on the bill accommodating unit side, it is sufficient to conduct the following operation. Existence of the bill sent out from the bill sensor is detected. In the case where the bill is detected, the conveyance roller is rotated in the direction to send the bill. Therefore, control for controlling the conveyance of the bill can be simplified. Since signals are not sent and received between the bill sensor and the bill accommodating unit, it is unnecessary for the bill sensor and the bill accommodating unit to make the protocol agree with each other. Therefore, it is possible to save time and labor. Accordingly, various bill validators can be set in the bill accommodating unit, and the manufacturing cost of the entire device can be reduced.

According to the bill handling device and the bill accommodating unit of the present invention, control of the entire handling device can be simplified, and further various bill validators can be easily set in the bill handling device.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE DRAWINGS

The accompanying drawings, which are incorporated in and constitute a part of the specification, illustrate embodiments of the invention, and together with the general description given above and detailed description of the embodiments given below, serve to explain the principles of the invention.

FIG. 1 is a perspective view showing an example of the bill handling device, wherein FIG. 1 shows a state in which the bill handling device is arranged in a slot machine which is a game machine.

FIG. 9 is a view showing a bill accommodating unit, wherein FIG. 9 shows a state in which bills are accommodated in a bill accommodating space.

DETAILED DESCRIPTION OF PREFERRED EMBODIMENT

Figure 1:
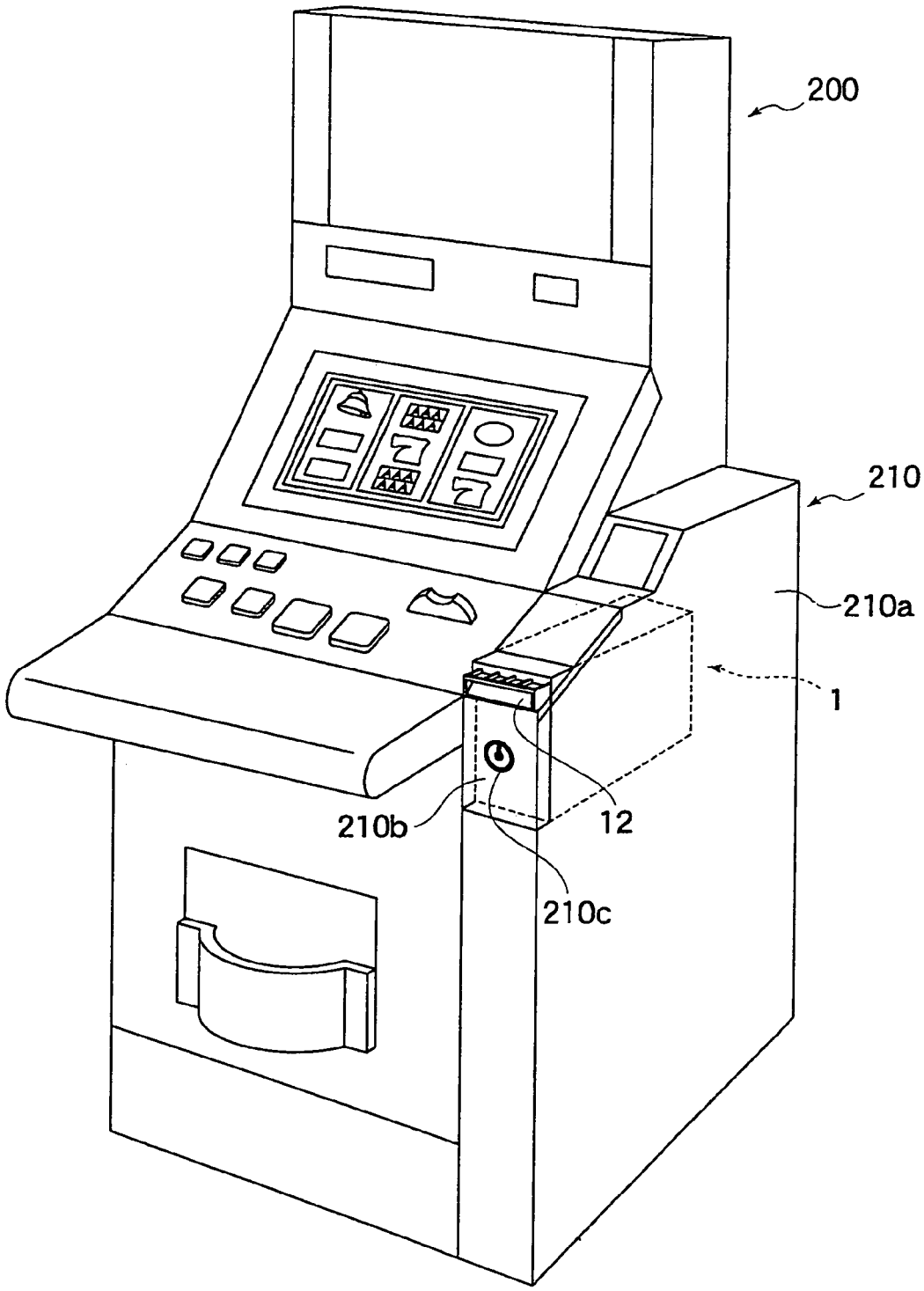

Referring to the accompanying drawings, an embodiment of the bill handling device of the present invention will be specifically explained below. As shown in FIG. 1, for example, the bill handling device of the present invention can be incorporated into a device (a so-called sandwich device) 210 arranged closely to the slot machines 200 which are game machines.

Figure 2:
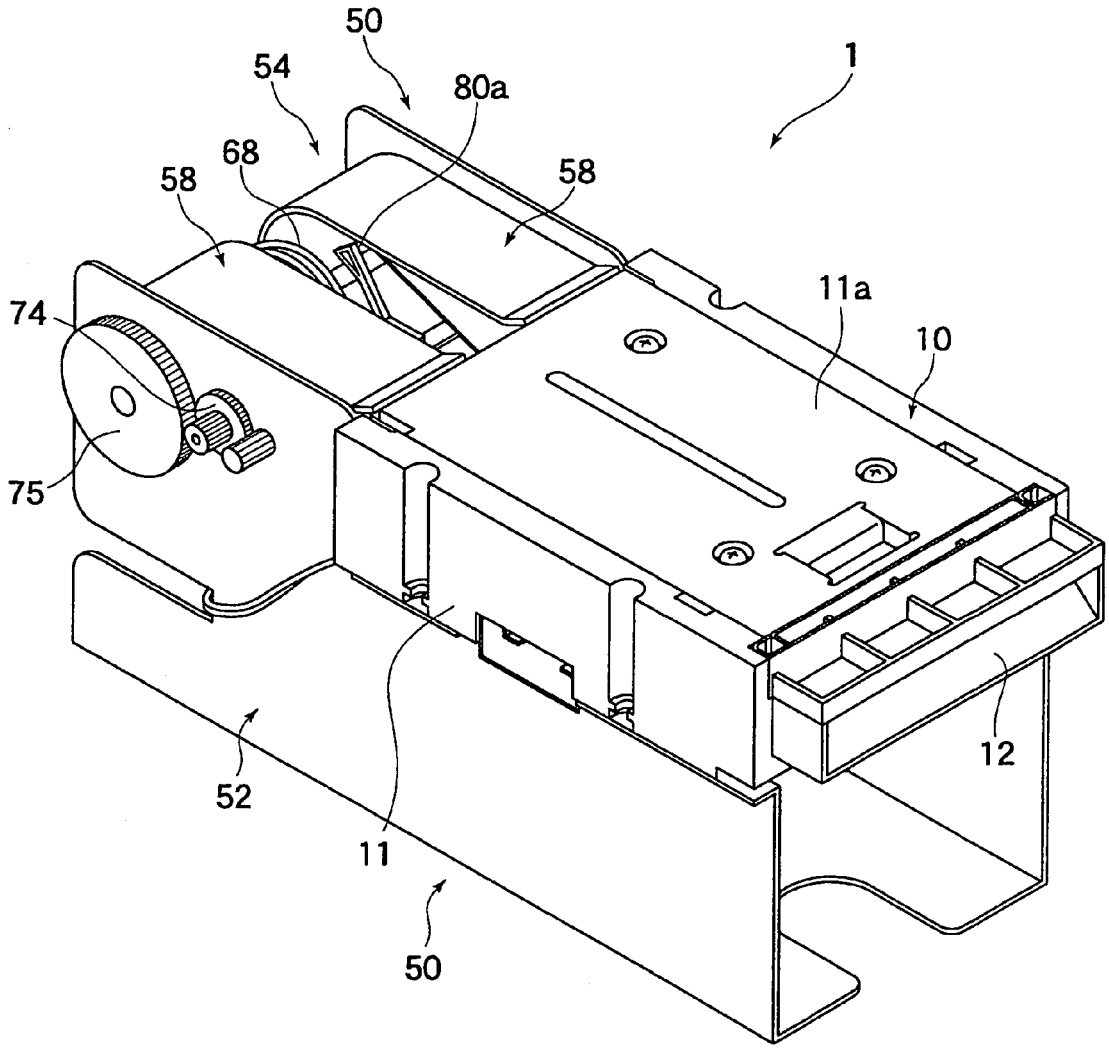
FIG. 2 is an overall arrangement view of the bill handling device.
Figure 3:
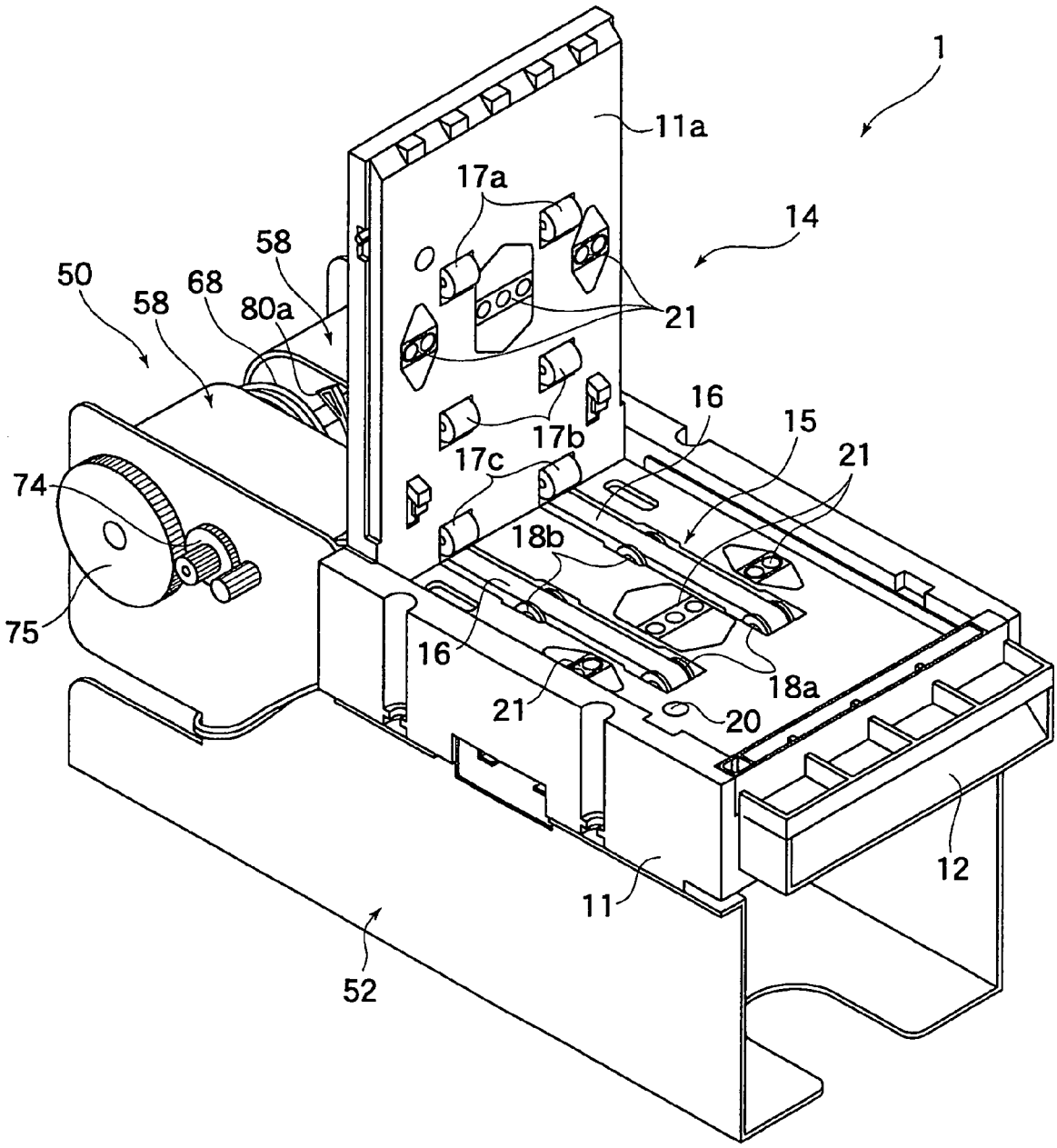
FIG. 3 is an arrangement view showing a bill validator arranged in the bill handling device.
Figure 4:
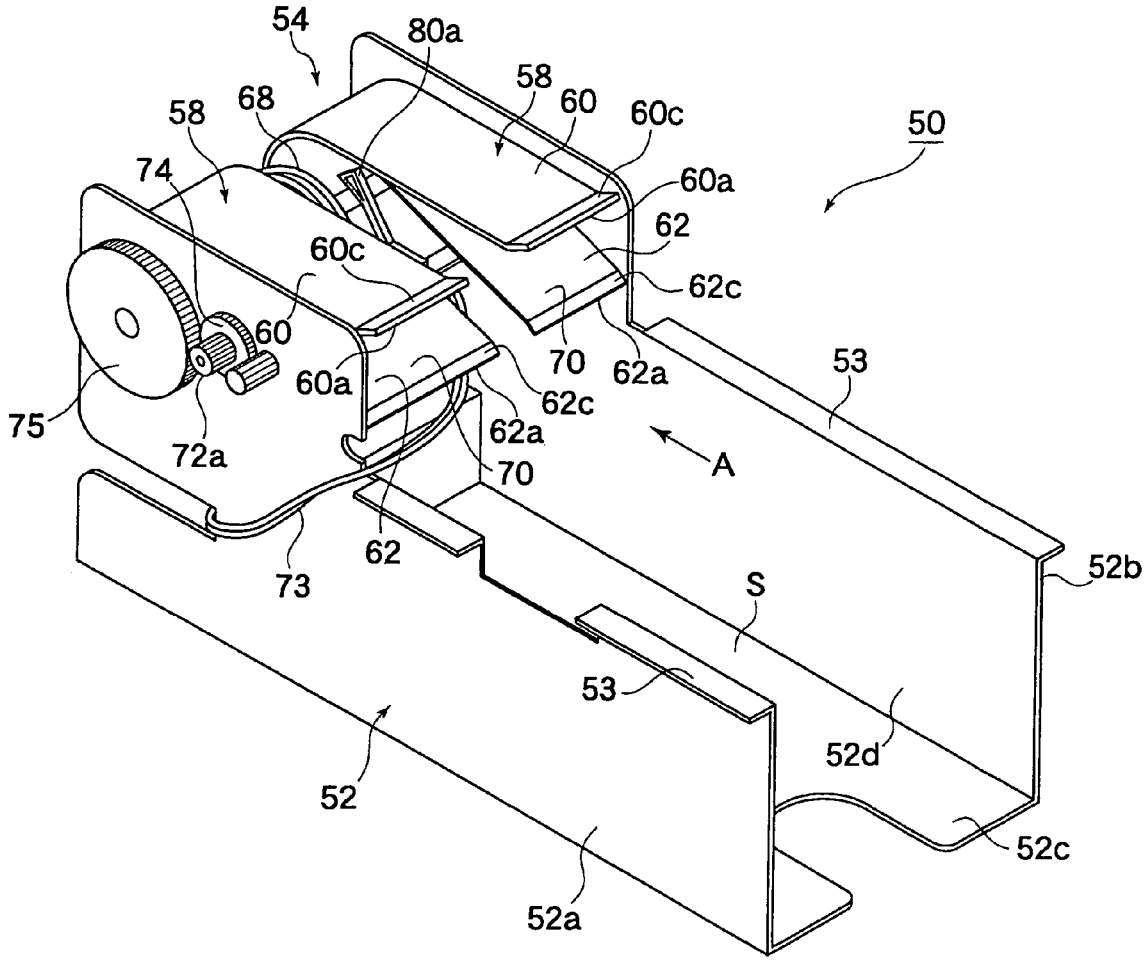
FIG. 4 is an arrangement view showing a bill accommodating unit.

FIGS. 2 to 5 are views showing the structure of the bill handling device incorporated into the device 210. FIG. 2 is an overall arrangement view of the bill handling device. FIG. 3 is a view showing the structure of the bill validator arranged in the bill handling device. FIG. 4 is a view showing the structure of the bill accommodating unit. FIG. 5A is a view taken in the direction of the arrow in FIG. 4. FIG. 5B is a view showing a state in which bills are accommodated in the bill accommodating unit in the state shown in FIG. 5A.

First of all, referring to FIGS. 1 to 3, the bill handling device and the bill validator composing the bill handling device will be explained below.

The bill handling device 1 incorporated into the device 210 is assembled and held at a predetermined position by an engaging structure provided in the frame 210*a* of the device 210. The bill validator 10 composing the bill handling device 1 is electrically connected to a game device for controlling the game of the slot machine 200. On the front face of the frame 210*a*, the opening and closing door 210*b*, which is opened and closed by a predetermined lock mechanism, is pivotally supported. When the opening and closing door 210*b* is opened, it becomes possible to take out bills accumulated and accommodated in the bill accommodating unit described later. In this connection, concerning the lock mechanism, when a predetermined key is inserted into the key hole 210*c*, the opening and closing door 210*b* can be locked and/or released.

The bill handling device 1 includes: a bill validator 10 for discriminating the validity of bills; and a bill accommodating unit 50 which is a base on which this bill validator 10 is arranged. In this case, the bill validator 10 may be detachably attached to the bill accommodating unit 50. Alternatively, the bill validator 10 may be previously attached to the bill accommodating unit 50 being integrated into one body.

The bill validator 10 includes a main body 11, the shape of which is formed into a substantial rectangular parallelepiped as a whole. On the front face of the main body 11, the rectangular bill insertion hole 12, into which bills are inserted, is formed.

In the main body 11, the bill discriminating section 14 is provided which is a bill sensor for discriminating the validity of bills inserted into the bill insertion hole 12. In this bill discriminating section 14, the bill conveyor 15 for conveying the bills with respect to the bill discriminating section 14 is provided. As shown in the drawing, the bill conveyor 15 is provided on the lower face side of the lid body 11*a*, which is opened and closed with respect to the main body 11, and on the upper face side of the main body 11. The bill conveyor 15 includes: two conveyance belts 16 extending on the surface of the main body 11 in the conveyance direction; and a plurality of pairs of conveyance rollers 17*a*, 17*b*, 17*c* which are rotatably supported on the lower face side of the lid body 11*a* and continuously come into contact with the conveyance belts 16 in the conveyance direction. The conveyance belts 16 are wound round pairs of drive rollers 18*a* driven and rotated by the drive motor 30 (shown in FIG. 10), which is a drive source, and also wound round a plurality of support rollers 18*b* (Only one pair of support rollers 18*b* are shown in the drawing.) rotatably supported by the main body 11. A predetermined frictional force (conveyance force) is generated between the conveyance belts 16 and the plurality of pairs of conveyance rollers 17*a*, 17*b*, 17*c*, so that the bills can be conveyed.

In this case, the bill conveyor 15 has a function of sending bills to the bill accommodating unit 50 side described later when the above drive motor is normally rotated. The bill conveyor 15 also has a function of sending the bills back to the bill insertion hole 12 side when the above drive motor is reversely rotated.

The bill conveyor 15 described above is arranged on the same plane as the bill guide face of the bill insertion hole 12. On the downstream side of the bill conveyor 15, a bill discharge hole (not shown) is provided.

Bills are conveyed by the bill conveyor 15 while the validity of the bills is being discriminated by the bill discriminating section 14. Then, the bills are sent out to the bill accommodating unit 50 side through the bill discharge hole. A bill conveyance force generated by the bill conveyor 15 is set to be stronger than a bill conveyance force (a frictional force generated between the conveyance rollers and the bill) generated by the conveyance roller arranged on the bill accommodating unit 50 side described later.

Figure 10:
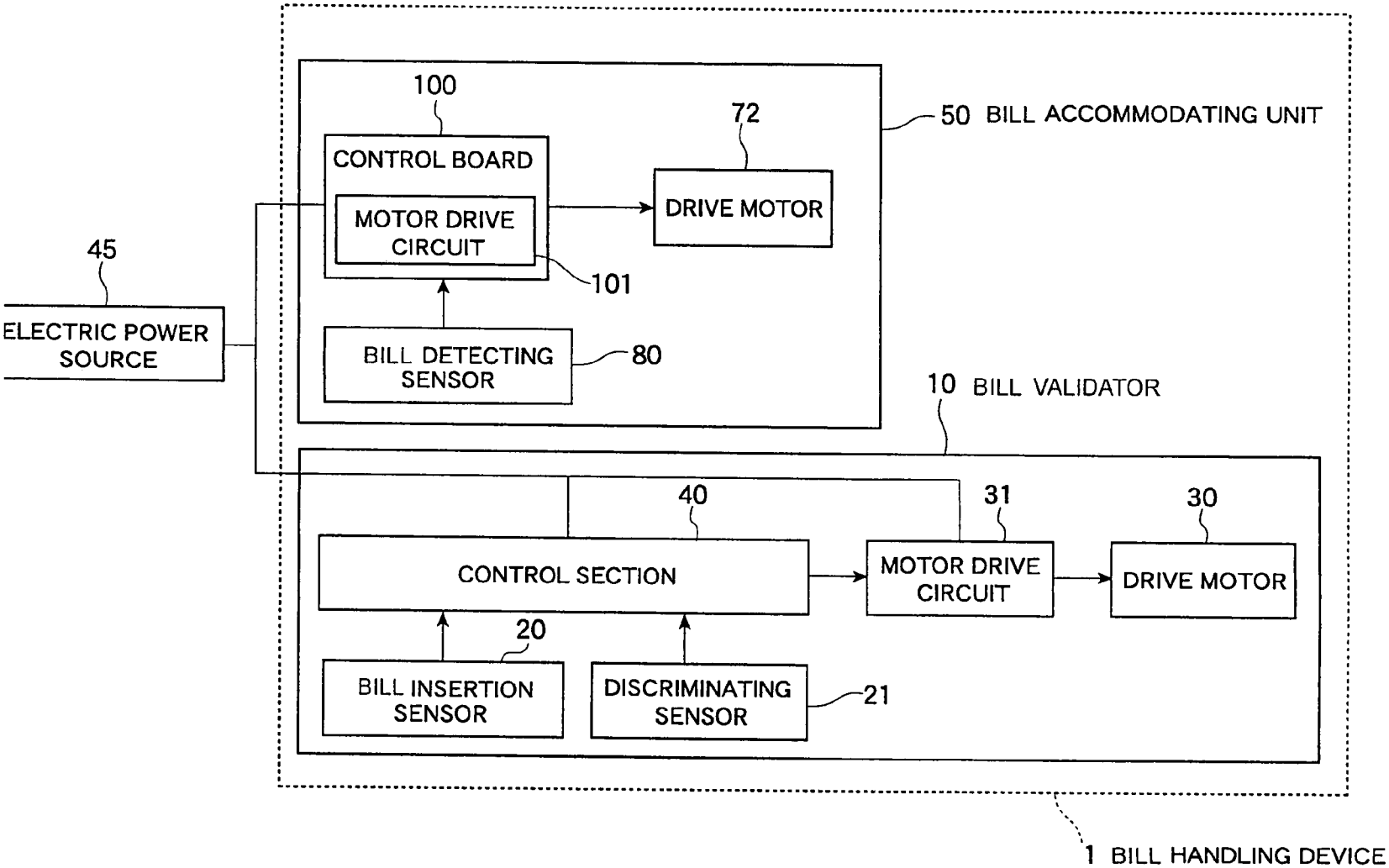
FIG. 10 is a block diagram showing an example of the control device for controlling the operation of the bill handling device.

The bill discriminating section 14 includes: a bill insertion sensor 20 having a function of detecting that a bill has been inserted into the bill insertion hole 12; and a bill discriminating sensor 21 having a function of discriminating the validity of the thus inserted bill, wherein the bill insertion sensor 20 and the bill discriminating sensor 21 are arranged in the conveyance direction of conveying the bill. The bill insertion sensor 20 and the bill discriminating sensor 21 are connected to the control section 40 having CPU, memory elements and others as shown in FIG. 10. According to the detection signals sent from these sensors 20, 21, the drive motor 30 is controlled through the motor drive circuit 31. In this connection, CPU compares the data of the genuine bill, which is previously stored in the memory element, with the detection data detected by the bill discriminating sensor 21 and judges whether or not the bill is valid.

In this case, a control section 40 and a drive motor 30 of the bill validator 10 are composed as follows. Signals about the conveyance and type of the bill to be conveyed are not sent and received between the control section 40 of the bill validator 10 and the bill accommodating unit 50 described later. Further, signals about the conveyance and type of the bill to be conveyed are not sent and received between the drive motor 30 and the bill accommodating unit 50 described later. Control of discriminating the bill and control of driving the drive motor 30 are conducted by electric power supplied from the predetermined electric power source 45. That is, the bill validator 10 does not send signals of information about the type and the conveyance of the bill to the bill accommodating unit 50. Further, the bill validator 10 does not receive signals of information about the type and the conveyance of the bill from the bill accommodating unit 50. That is, the bill validator 10 singly executes controlling. In this connection, the following constitution may be adopted. As described before, the control section 40 of the bill validator 10 sends signals about the type of the bill to the game device for controlling the game of the slot machine 200. According to the signals which have been sent to the game machine in this way, the credit accompanied by the game is executed on the slot machine side.

Next, referring to FIGS. 4 and 5, explanations will be made into the constitution of the bill accommodating unit 50 to which the bill validator 10 is detachably attached. In this connection, for the convenience of explanations, the side on which the bill insertion hole 12 of the bill handling device 1 is located is defined as a front side, and the opposite side is defined as a rear side. The side on which the bill validator 10 is located is defined as an upper side, and the opposite side (the side on which bill accommodating spaces is located) is defined as a lower side.

As shown in FIGS. 4 and 5, the bill accommodating unit 50 includes: a substantially box-shaped bill accommodating section 52 for vertically laminating and accommodating bills P; and a conveyance mechanism 54 for conveying bills P, which have been sent out from the bill validator 10, to the bill accommodating section 52.

The bill accommodating section 52 forms bill accommodating space S for accommodating bills P by a pair of side plates 52*a*, 52*b* and a bottom plate 52*c* to connect these side plates 52*a*, 52*b*. The upper portion and the front portion of bill accommodating space S are open. In this case, the front opening 52*d* composes a hole for taking out bills P laminated and accommodated in bill accommodating space S. When the opening and closing door 210*b* shown in FIG. 1 is opened, bills P can be taken out from bill accommodating space S. Upper end faces of both side plates 52*a*, 52*b* are protruded in the lateral direction by a predetermined width. Therefore, the upper end faces of both side plates 52*a*, 52*b* compose support faces 53 for supporting the bill validator 10 from the lower side.

On the other hand, the conveyance mechanism 54 includes: a pair of guide sections 58, 58 for guiding bills P, which have been sent out from the bill validator 10, toward bill accommodating space S of the bill accommodating section 52; and a conveyance roller 68 arranged at a predetermined position arranged between these guide sections 58, 58. In this case, the pair of guide sections 58 compose a loop-shaped conveyance passage for connecting the bill discharge hole of the bill validator 10 with bill accommodating space S located on the lower side of the bill validator 10. The pair of guide sections 58 are arranged on both sides of the conveyance passage so that they can guide bills P while the guide sections 58 are supporting both sides of bills P.

Specifically, each guide section 58 is composed of a pair of guide plates 60, 62 which are respectively located on the upper and the lower side. In this case, between one end 60*a* of the upper guide plate 60, which is opposed to the bill discharge hole of the bill validator 10, and one end 62*a* of the lower guide plate 62, the introducing hole 70 for receiving bills P, which are discharged from the bill discharge hole, is formed. In this connection, tapered faces 60*c*, 62*c*, which are inclined in the vertical direction, are formed at one end portions 60*a*, 62*a* of the upper 60 and the lower guide plate 62 so that bills P can be smoothly introduced into the introduction hole 70 without causing any problems.

The upper guide plate 60 is extended backward from its one end portion 60*a* by a predetermined length and folded back to the front side being formed into a loop-shape (a substantially U-shape). The other end portion 60*b* (shown in FIGS. 5A and 5B) is formed being directed to the front side so that it can be opposed to bill accommodating spaces. On the other hand, the lower guide plate 62 is extended to the rear side obliquely upward from its one end portion 62*a* by a predetermined length and ends at the other end portion 62*b* (shown in FIGS. 5A and 5B) without being folded back. In this case, the position of the other end portion 62*b* of the lower guide plate 62 is set at a position where an end portion of bill P, which is guided by the lower guide plate 62, can be contacted with an upper end portion of the conveyance roller 68 at the point of time when the end portion of bill P has reached the other end portion 62*b* of the lower guide plate 62.

The conveyance roller 68 arranged between the pair of the guide sections 58, 58 is composed of, for example, a metallic roller body 68*a* and a contact ring 68*b* made of rubber coming into contact with bill P. The conveyance roller 68 is set as follows. When bill P is conveyed, a frictional force generated between the conveyance roller 68 and the bill, that is, a conveyance force generated between the contact ring 68*b* and the bill is weaker than a conveyance force of the bill conveyor 15 generated by the above bill validator 1. The conveyance roller 68 is fixed to the rotary shaft 76 (shown in FIG. 5A). Both end portions of this rotary shaft 76 are pivotally supported by the side plates 52*a*, 52*b* of the bill accommodating section 52.

Figure 5A:
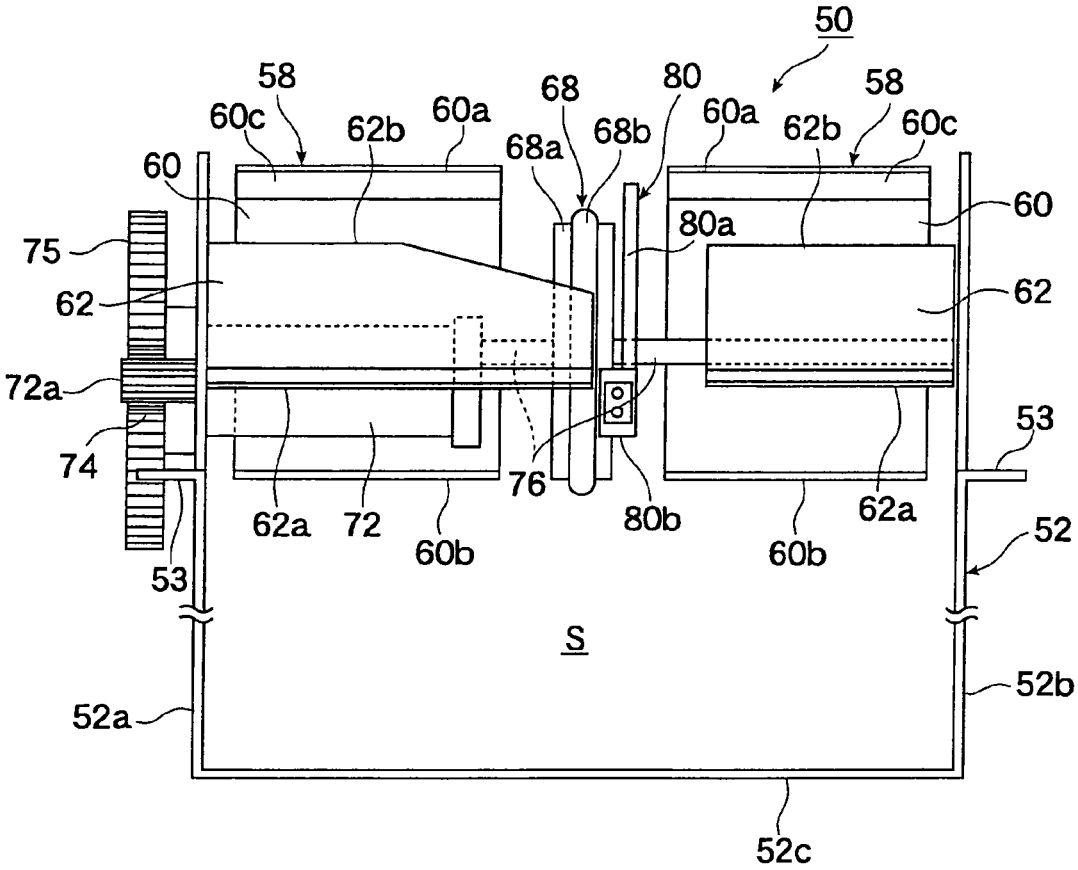
FIG. 5A is a view taken in the direction of the arrow in FIG. 4.
Figure 5B:
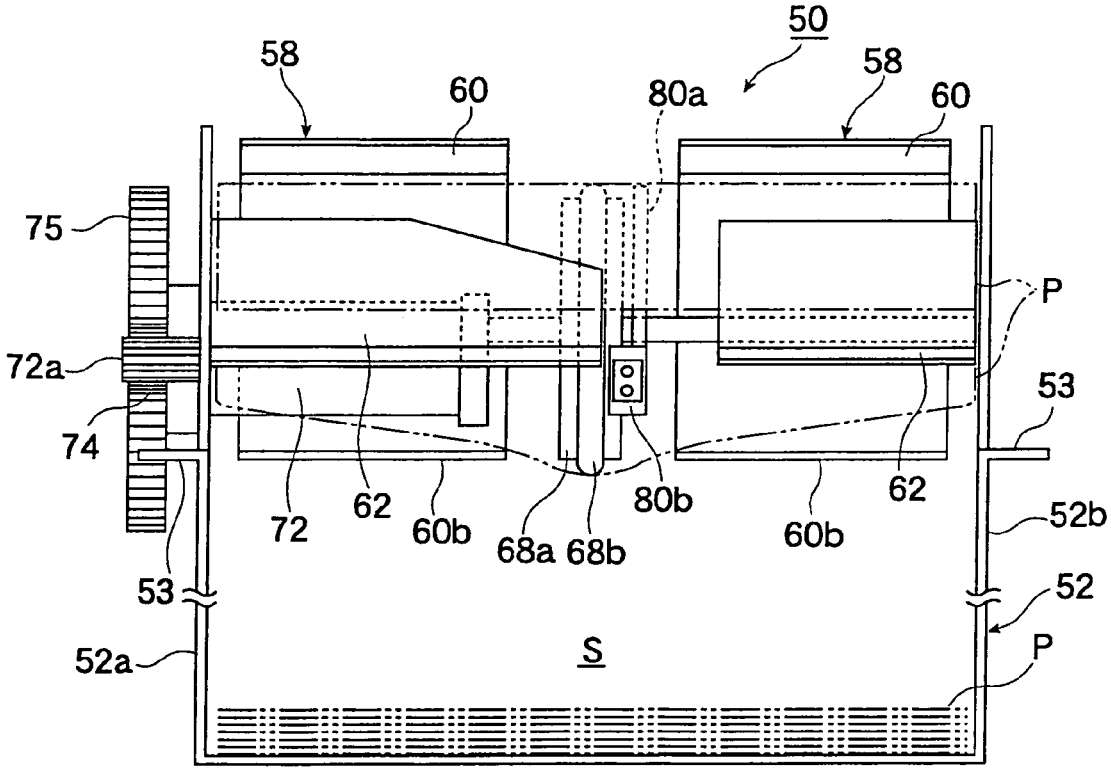
FIG. 5B is view showing a state in which bills are accommodated in the bill accommodating unit in the state shown in FIG. 5A.

In this embodiment, the conveyance roller 68 is positioned so that a predetermined positional relation can be established between the conveyance roller 68 and the other end portions 60*b*, 60*b* of the upper guide plates 60, 60 of the pair of guide sections 58, 58. Specifically, as shown in FIG. 5A, a lower end portion of the conveyance roller 68 is positioned at a position where the lower end portion of the conveyance roller 68 protrudes from the other end portions 60*b*, 60*b* of the upper guide plates 60, 60. Due to the above arrangement, as shown in FIG. 5B, bill P passing through the lower end portion of the conveyance roller 68 is interposed between the other end 60*b*, 60*b* of the upper guide plates 60, 60 and the conveyance roller 68 so that bill P can be bent into a substantial V-shape. In this connection, in this embodiment, in order to enhance a bending force to be given to bill P, the width of the contact ring 68*b* is set to be smaller than the width of the roller body 68*a*.

As clearly shown in FIGS. 5(*a*), 5(*b*), in -the lower portion of the lower guide plate 62 of one guide section 58, the drive motor 72 for driving and rotating the conveyance roller 68 is arranged. The first gear 74, the diameter of which is small, is attached and fixed to one end of the rotary drive shaft 72*a* of this drive motor 72. This first gear 74 is meshed with the second gear 75, the diameter of which is large, attached and fixed to one end of the rotary shaft 76 of the conveyance roller 68. Torque of the motor 72 is transmitted to the conveyance roller 68 while the rotating speed of the motor 72 is reduced by a predetermined gear ratio.

At a predetermined position (in this embodiment, a position between the lower guide plates 62, 62 of the pair of guide sections 58, 58) between the pair of guide sections 58, 58, the bill detection sensor 80 is arranged which is a bill detector for detecting bill P sent out from the bill discharge hole of the bill validator 10. This bill detection sensor 80 is supported from the lower side, for example, by a support member extending from one side plate 52*b*. This bill detection sensor 80 includes: a movable detection body 80*a* coming into contact and rotating together with bill P; and a sensor body 80*b* for detecting the rotation of the movable detecting body 80*a* and generating a detection signal. In this connection, the position at which the bill detecting sensor 80 is arranged may be any position as long as the bill detecting sensor 80 can detect that the bill has been sent out from the bill discharge hole of the bill validator 10 and can drive and rotate the conveyance roller 68. For example, the bill detecting sensor 80 may be arranged in the bill conveyance passage between the conveyance roller 68 and the bill conveyor 15.

The sensor body 80*b* is fixed to the bill accommodating unit 50 and electrically connected via the signal line 73 to the control board 100 on which the motor drive circuit 101 is mounted as shown in FIG. 10. The control board 100 conducts controlling in such a manner that the drive motor 72 is driven only while a detection signal is being received from the sensor body 80*b*. That is, in this embodiment, only while the movable detecting body 80*a* is being rotated from the initial position shown in FIG. 4, that is, only while bill P is coming into contact with the movable detecting body 80*a*, the conveyance roller 68 is driven and rotated in the direction so that the bill can be sent into bill accommodating spaces. Only when the control board 100 is supplied with electric power from the electric power source 45 and the bill detecting sensor 80 detects the existence of the bill, the control board 100 conducts controlling so that the above conveyance roller 68 can be rotated. That is, signals expressing the type and conveyance of the bill are not sent and received between the control board 100 and the bill validator 10. Accordingly, the above conveyance roller 68 is driven and rotated independently from the above bill conveyor 15.

Next, referring to FIGS. 3, 6 to 9 and 10, operation of the bill handling device composed as described above will be explained below. In this connection, the lid body 11*a* of the bill validator 10 is omitted in FIGS. 6 to 8.

Figure 6:
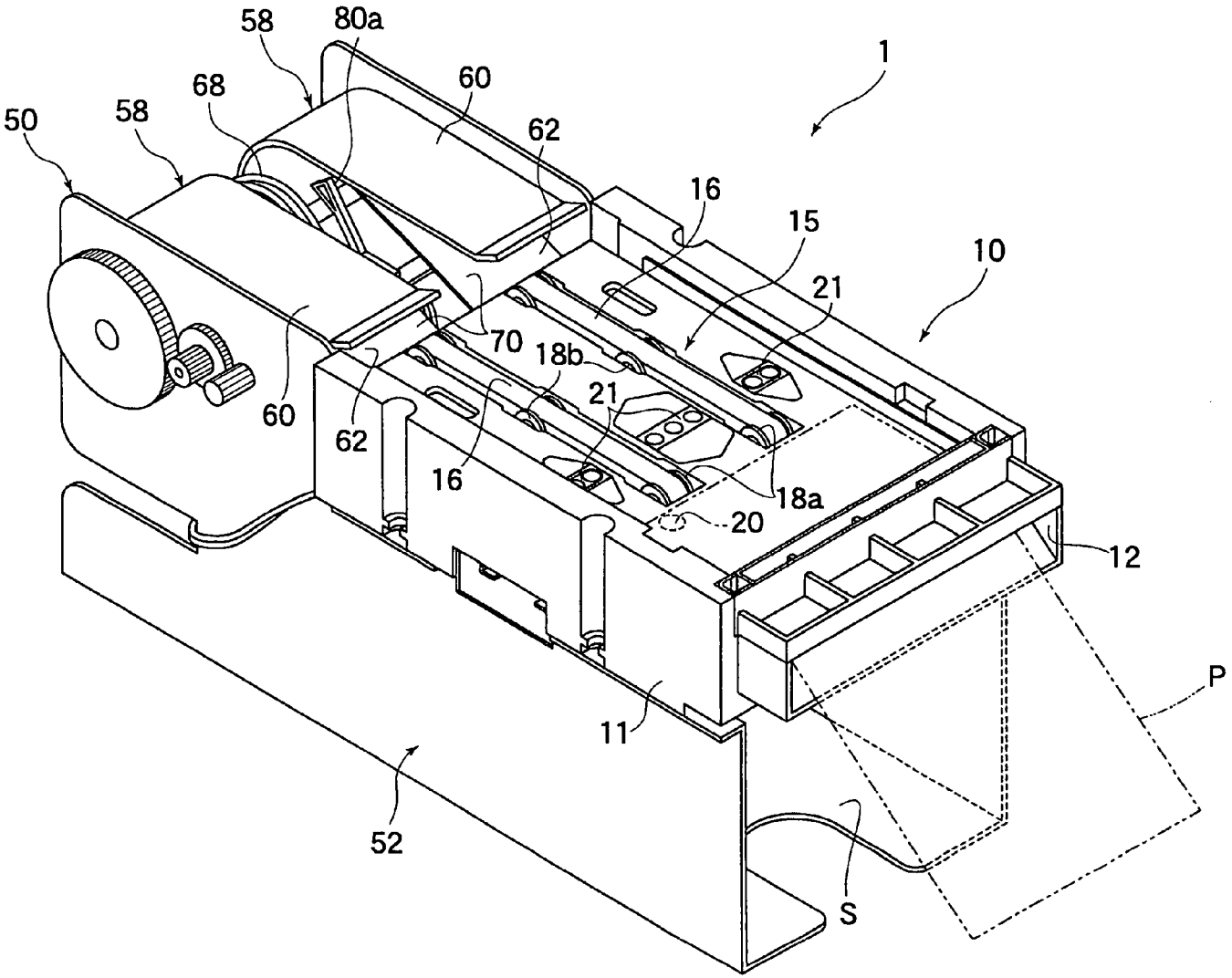
FIG. 6 is a view showing a state in which a bill is inserted into the bill validator.
Figure 7:
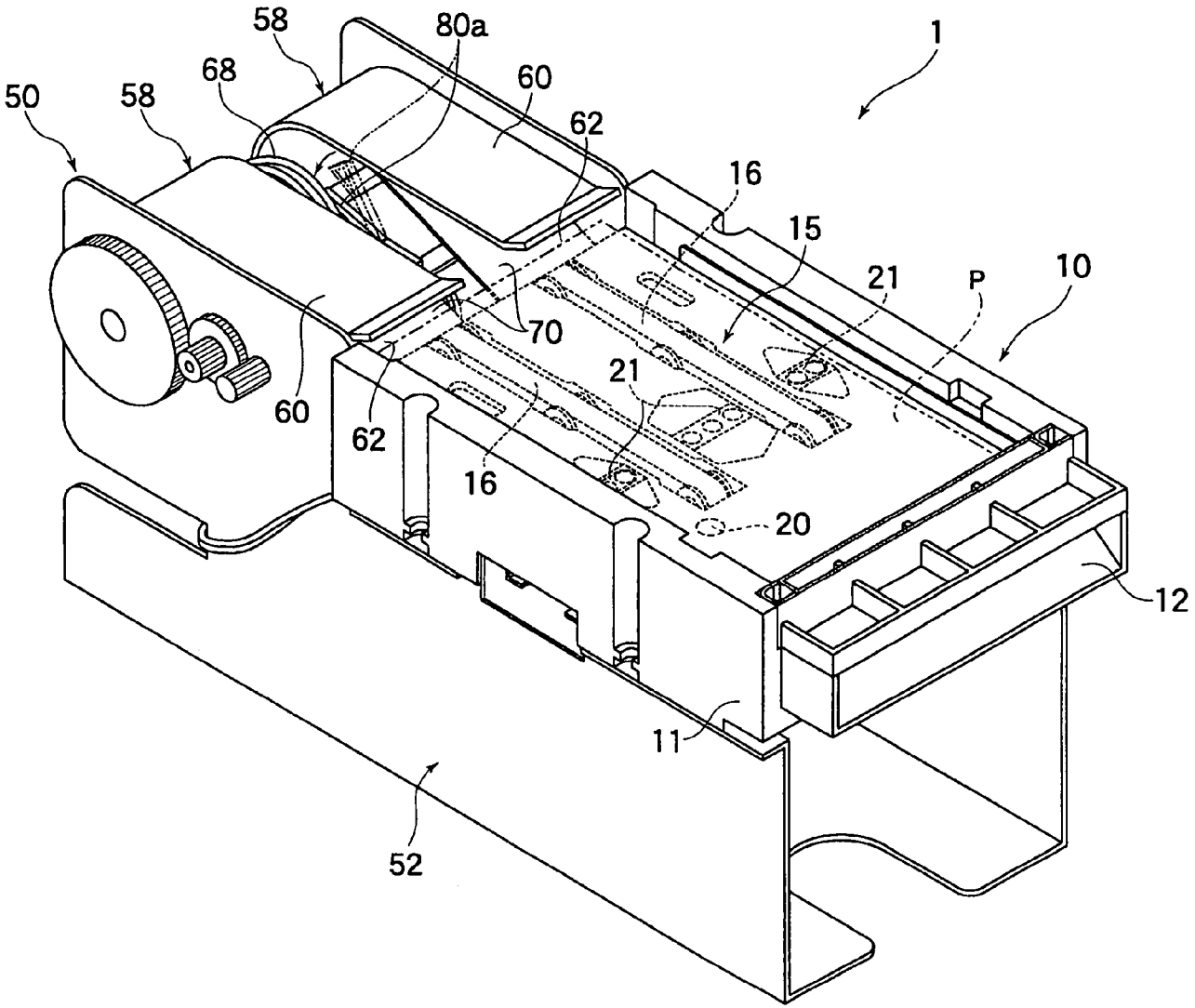
FIG. 7 is a view showing a state in which a bill is discriminated by the bill validator.

As shown in FIG. 6, when bill P is inserted into the bill insertion hole 12 of the bill validator 10, a forward end portion of bill P is detected by the bill insertion sensor 20, and the drive motor 30 composing the bill conveyor 15 is driven and rotated. Due to this rotation of the bill conveyor, bill P is conveyed to the bill accommodating unit 50 while bill P is being interposed between the conveyance belts 16 and a plurality of pairs of conveyance rollers 17, 17*b*, 17*c* which are in contact with the conveyance belts. At the time of conveying bill P, the bill discriminating sensor 21 sends a detection signal, which is obtained from bill P, to the control section 40. In the control section 40, this obtained detection signal is compared with the data of the genuine bill so as to judge the validity of the bill. The judgment of the validity of the bill is executed by detecting the bill in the longitudinal direction while the bill is being conveyed from FIG. 6 to FIG. 8.

While bill P is being conveyed by the bill conveyor 15 and judged whether or not it is valid, a forward end portion of bill P is sent out from the bill discharge hole and guided into the introducing hole 70 of the bill accommodating unit 50 and soon contacted with the movable detection body 80*a* of the bill detection sensor 80. At this time, the movable detection body 80*a* is rotated downward by the weight of the bill in the direction of the arrow shown in FIG. 7. Due to the rotation of the movable detection body 80*a*, a detection signal is sent from the sensor body 80*b* to the control board 100, and the drive motor 72 is driven and rotated in the bill sending direction. In the case where bill P is judged to be valid, bill P is sent from the above introducing hole 70 to bill accommodating space S via the lateral pair of upper and lower guide plates 60, 62 by the rotation of the conveyance roller 68, which is driven by the drive motor 72, and also by the rotation of the bill conveyor 15 in the sending direction. At this time, while bill P is being bent into a substantial V-shape between the other end portions 60*b*, 60*b* of the upper side guide plates 60, 60 and the conveyance roller 68, bill P is conveyed being interposed when bill P passes through the lower end portion of conveyance roller 68 (shown in FIG. 5B and FIG. 9). At this time, wrinkles on bill P are removed. That is, bill P can be flattened. Therefore, without providing a pushing mechanism for successively pushing the bills into bill accommodating space S, bills P can be tightly laminated and accommodated in bill accommodating space S with a simple structure.

Figure 8:
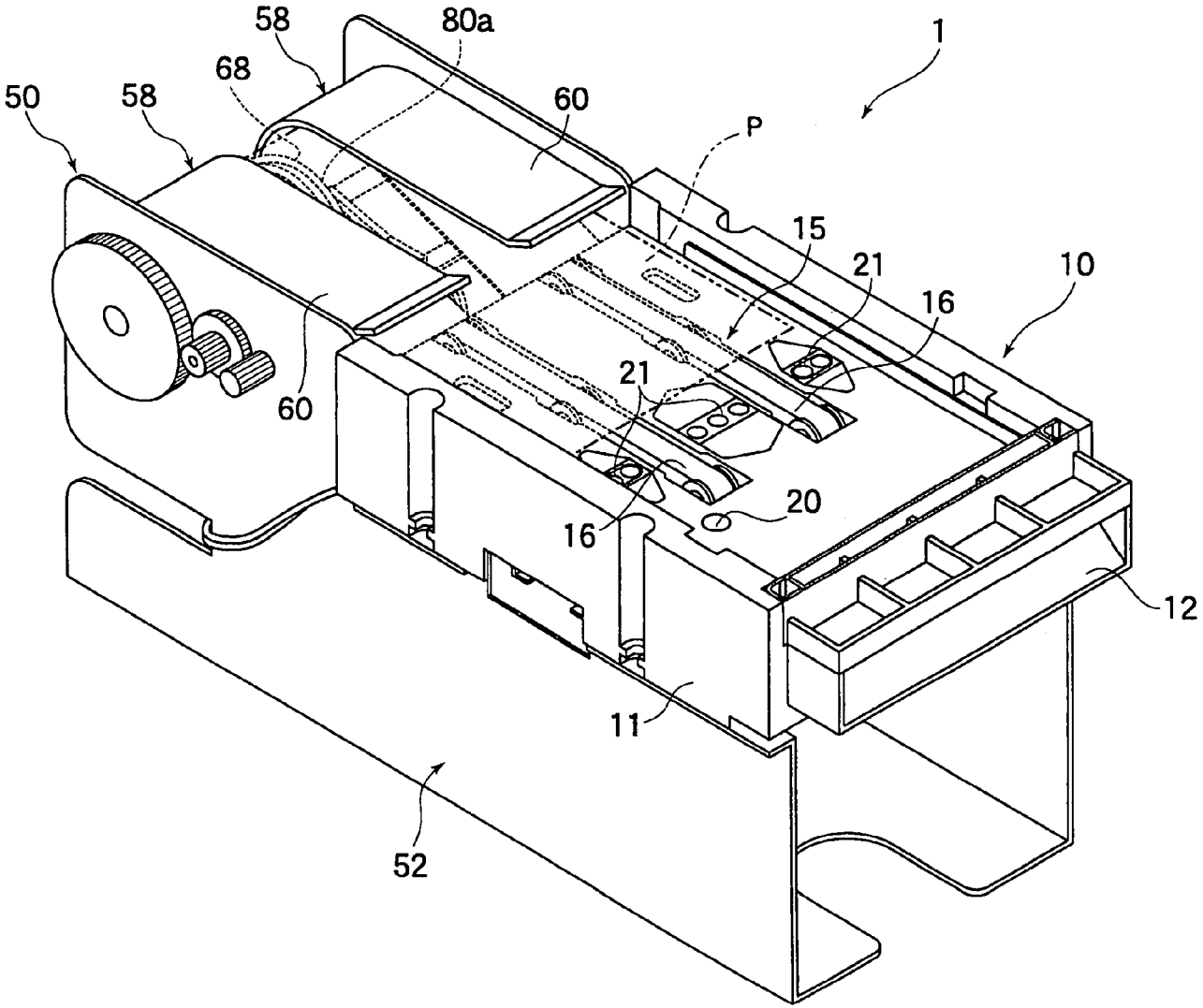
FIG. 8 is a view showing a state in which the bill discrimination has been completed by the bill validator.
Figure 9:
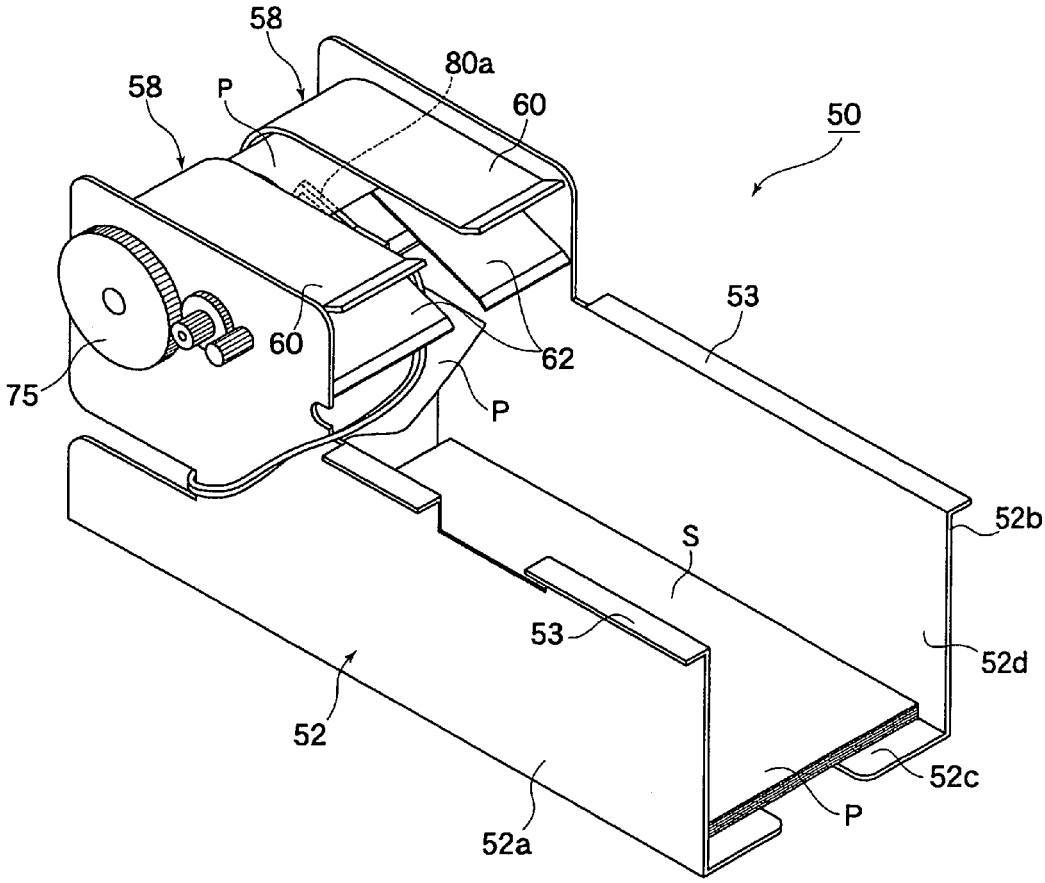

On the other hand, in the case where bill P, which has been inserted, is judged to be not valid, under the condition shown in FIG. 8, the drive motor 30 of the bill conveyor 15 is once stopped. After that, the drive motor 30 of the bill conveyor 15 is reversed. Due to the foregoing, bill P, which has been judged to be not valid, is sent back to the bill insertion hole 12. At this time, as described before, since a conveyance force of the bill conveyor 15 is set to be stronger than a conveyance force of the conveyance roller 68, even when the conveyance roller 68 is rotated while the movable detecting body 80*a* is rotated downward as shown by the arrow in FIG. 7, bill P is not conveyed toward bill accommodating space S, that is, bill P can be sent back by the bill conveyor 15 as it is.

According to the bill handling device 1 composed as described above, concerning the bill which is conveyed while its validity is being judged, only the following operation may be conducted. On the bill accommodating unit 50 side, the existence of the bill sent from the bill validator 10 side is simply detected. In the case where the existence of the bill is detected, it is sufficient that the conveyance roller 68 is driven and rotated in the bill sending direction. Therefore, control can be simplified when the bill is conveyed. Since no signals are sent and received between the bill validator 10 and the bill accommodating unit 50, it is unnecessary to make the protocol of the signal agree with each other between the bill validator 10 and the bill accommodating unit 50. Therefore, for example, various types of bill validator 10 manufactured by different manufacturers can be easily arranged in the bill accommodating unit 50. At the same time, the manufacturing cost of the entire device can be reduced.

The above bill accommodating unit 50 is composed in such a manner that while the bill is being formed into a loop-shape, wrinkles on the bill are removed by a pair of guide plates. Therefore, it is unnecessary to provide a pushing device for pushing the bill. The conveyance mechanism is composed of one conveyance roller 68, and the bills -are respectively formed into a loop-shape by the rotation of the conveyance roller 68 and successively laminated and put into bill accommodating space S which is a bill accommodating section. Therefore, the number of components can be decreased as small as possible, and the constitution of the bill accommodating unit 50 can be simplified and the manufacturing cost can be reduced.

The embodiment of the present invention is explained above. However, it should be noted that the present invention is not limited to the above specific embodiment. Various variations may be made by those skilled in that art.

For example, the conveyance roller 68 provided in the bill accommodating unit may be composed of a pair of rollers. Alternatively, a plurality of conveyance rollers 68 may be arranged in the bill conveyance direction. The bill detection sensor 80 for detecting the existence of the bill is not limited to the mechanical type sensor. The bill detection sensor 80 for detecting the existence of the bill may be an optical type sensor. The guide plates for removing wrinkles from the bill is composed so that the bill can be bent into a substantial V-shape while the bill is being formed into a loop-shape. However, three guide plates may be arranged in the horizontal direction so that the bill can be bent into a substantial W-shape so as to remove wrinkles from the bill. In the above embodiment, the guide plates are arranged on both the right and the left. However, the guide plate may be arranged only on either side. Alternatively, the guide plate may be composed of one plate member. In this case, a slit may be formed in the bill conveyance portion and the bill detecting sensor may be arranged in this portion.

The use of the bill handling device of the present invention is not limited to the above slot machine. The bill handling device of the present invention can be applied to various game machines. Further, the bill handling device of the present invention can be incorporated into an outside device such as a vending machine.

In order to accomplish the above objects, a third aspect of the present invention provides a bill accommodating unit comprising: a bill validator including bill sensor for discriminating the validity of a bill inserted into a bill insertion slot, and bill conveyor for conveying the bill to the predetermined position and sending the bill, which has been discriminated to be invalid, back to the bill insertion slot, the bill accommodating unit further comprising: a bill accommodating section for accommodating a bill; bill detector for detecting the bill which has been sent out; and a conveyance roller for conveying the bill to the bill accommodating section side independently from the bill conveyor by a conveyance force weaker than the conveyance force of conveying the bill by the bill conveyor while the bill detector is detecting the bill. According to the bill accommodating unit of a fourth aspect of the invention, the bill detector is arranged at a predetermined position from which the bill conveyor sends out the bill.

According to the bill accommodating unit composed as described above, operation is conducted as follows. In the case where the validity of a bill, which has been inserted into the bill insertion slot, is judged by the bill validator arranged in the bill accommodating unit, the bill is sent to a predetermined position by the bill conveyor of the bill validator. At this predetermined position, the bill detector for detecting the bill is arranged. Therefore, when the bill is detected, the conveyance roller is driven and rotated so that the bill can be conveyed to the bill accommodating section. Therefore, the bill conveyor and the conveyance roller of the bill validator is driven and rotated to covey the bill which has been judged to be valid to the bill accommodating section. On the other hand, in the case where the bill sensor has judged that the bill is invalid , the bill conveyor of the bill validator sends the bill back to the bill insertion slot, that is, the bill conveyor is reversely driven. At this time, a forward end portion of the bill is located at the predetermined position described above. Even when the bill detector detects the bill and the conveyance roller is rotated being driven, since a conveyance force of conveying the bill by the conveyance roller is set to be weaker than a conveyance force of conveying the bill by the bill conveyor, the bill is sent back to the bill insertion slot by the bill conveyor irrespective of the rotation of the conveyance roller.

In the case of conveying the bill which has been judged to be valid, on the bill accommodating unit side, it is sufficient to conduct the following operation. Existence of the bill sent out from the bill sensor is detected. In the case where the bill is detected, the conveyance roller is rotated in the direction to send . the bill. At the time of sending the bill back to the bill insertion slot, the conveyance of the bill is not affected at all. Therefore, control for controlling the conveyance of the bill can be simplified.

According to a fifth aspect of the invention, in the bill accommodating unit according to the third aspect of the invention, bills sent in by the conveyance roller are successively laminated in the bill accommodating section. According to a sixth aspect of the invention, in the bill accommodating unit according to the fourth aspect of the invention, bills sent in by the conveyance roller are successively laminated in the bill accommodating section.

According to the above constitution, in the bill accommodating unit, bills are successively laminated in the bill accommodating section as they are by the rotation of the conveyance roller. Therefore, the number of components can be decreased as small , as possible, and the constitution of the bill accommodating unit can be simplified.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A bill handling device comprising:

a bill validator including a main body having a front face including a bill insertion slot, a lid which is opened and closed with respect to the main body, a bill conveyance passage located between the main body and the lid, a bill sensor arranged in the bill conveyance passage for discriminating validity of a bill inserted into the bill insertion slot, and a bill conveyor for conveying the bill inserted to a predetermined position for discriminating the validity of the bill by the bill sensor and sending a bill, which has been discriminated to be invalid by the bill sensor, back to the bill insertion slot; and a bill accommodating unit including a bill accommodating section for accommodating a bill, wherein the bill accommodating section is located below the bill validator, a bill detector for detecting the bill which is being sent to the accommodating section, a conveyance roller for conveying the bill to the bill accommodating section, independently from the bill conveyor, by a conveyance force weaker than a conveyance force of conveying the bill, applied by the bill conveyor while the bill detector is detecting the bill, and a pair of guide sections for guiding the bill to the bill accommodating section, while folding back the bill into an approximate U-shape as viewed in a longitudinal cross section with respect to the direction of conveyance, wherein the conveyance roller is located between the guide sections, and a lower end of the conveyance roller protrudes farther than the pair of guide sections for bending the bill, which passes below the lower end of the conveyance roller, into an approximate V-shape as viewed in a transverse cross section with respect to the direction of conveyance, between the guide sections while the bill is folded back in a U-shape as viewed in a longitudinal cross section with respect to the direction of conveyance by the conveyance roller.

2. A bill accommodating unit comprising:

a bill validator including a main body having a front face including a bill insertion slot, a lid which is opened and closed with respect to the main body, a bill conveyance passage located between the main body and the lid, a bill sensor arranged in the bill conveyance passage for discriminating validity of a bill inserted into the bill insertion slot, and a bill conveyor, arranged between the main body and the lid, for conveying the bill inserted to a predetermined position for discriminating the validity of the bill by the bill sensor and sending a bill, which has been discriminated to be invalid, back to the bill insertion slot;

a bill accommodating section for accommodating a bill, wherein the bill accommodating section is located below the bill validator;

a bill detector for detecting the bill which has been sent out by the bill conveyor; and a conveyance roller for conveying the bill to the bill accommodating section, independently from the bill conveyor, by a conveyance force weaker than a conveyance force of conveying the bill, applied by the bill conveyor while the bill detector is detecting the bill, a pair of guide sections for guiding the bill to the bill accommodating section, while folding back the bill into an approximate U-shape as viewed in a longitudinal cross section with respect to the direction of conveyance, wherein the conveyance roller is located between the guide sections, and a lower end of the conveyance roller protrudes farther than the pair of guide sections for bending the bill, which passes below the lower end of the conveyance roller, into an approximate V-shape as viewed in a transverse cross section with respect to the direction of conveyance, between the guide sections while the bill is folded back in a U-shape as viewed in a longitudinal cross section with respect to the direction of conveyance by the conveyance roller.

* * * * *